US006309137B1

(12) United States Patent
Hirsch

(10) Patent No.: US 6,309,137 B1
(45) Date of Patent: Oct. 30, 2001

(54) PORTABLE SPEED BUMP FOR TRAFFIC REGULATION

(76) Inventor: Robert Hirsch, 1610 Meadowbrook Heights Rd., Charlottesville, VA (US) 22901

( * ) Notice: Subject to any disclaimer, the term of this patent is extended or adjusted under 35 U.S.C. 154(b) by 0 days.

(21) Appl. No.: 09/328,650

(22) Filed: Jun. 9, 1999

(51) Int. Cl.[7] ..... E01F 11/00
(52) U.S. Cl. ..... 404/15
(58) Field of Search ..... 404/6, 7, 9, 15, 404/16, 19; 238/14

(56) References Cited

U.S. PATENT DOCUMENTS

| | | | | |
|---|---|---|---|---|
| D. 348,230 | | 6/1994 | Shairba | D10/113 |
| D. 387,181 | | 12/1997 | Sinclair | D25/102 |
| 3,918,638 | * | 11/1975 | Nelson | 238/14 |
| 4,203,685 | | 5/1980 | Sanchez | 404/6 |
| 4,362,424 | | 12/1982 | Barber | 404/6 |
| 5,106,226 | | 4/1992 | Fanslow et al. | 404/15 |
| 5,137,391 | * | 8/1992 | Ballesteros | 404/6 |
| 5,306,105 | | 4/1994 | Langbrandner et al. | 404/12 |
| 5,327,850 | * | 7/1994 | Sly et al. | 116/63 P |
| 5,392,728 | * | 2/1995 | Speer et al. | 116/63 R |
| 5,605,413 | * | 2/1997 | Brown | 404/6 |
| 5,769,563 | * | 6/1998 | Flynn | 404/15 |

FOREIGN PATENT DOCUMENTS

| | | | | |
|---|---|---|---|---|
| 2030197 | * | 4/1980 | (GB) | 404/15 |
| 91/19856 | * | 12/1991 | (WO) | 404/15 |

* cited by examiner

*Primary Examiner*—Thomas B. Will
*Assistant Examiner*—Gary S. Hartmann
(74) *Attorney, Agent, or Firm*—Sheldon H. Parker

(57) ABSTRACT

A portable speed bump, for use in limiting the speed of vehicles that are traveling on a road, is formed from a plurality of elongated speed bump modules. Each module has a cross-section that has at the most, a low slope from the outer edges toward the mid-line and a substantially increased slope proximate the module mid-line, a length of at least two feet, a width of at least one foot, and a height of at least one inch. Each module has an upper surface which has a concave slope region from outer edge to middle section and a convex middle section. Anti-skid elements can extend from the planar lower surface, whereby lateral movement of said speed bump is resisted. The elements can be a plurality of substantially parallel, outwardly angled anti-skid fingers.

13 Claims, 9 Drawing Sheets

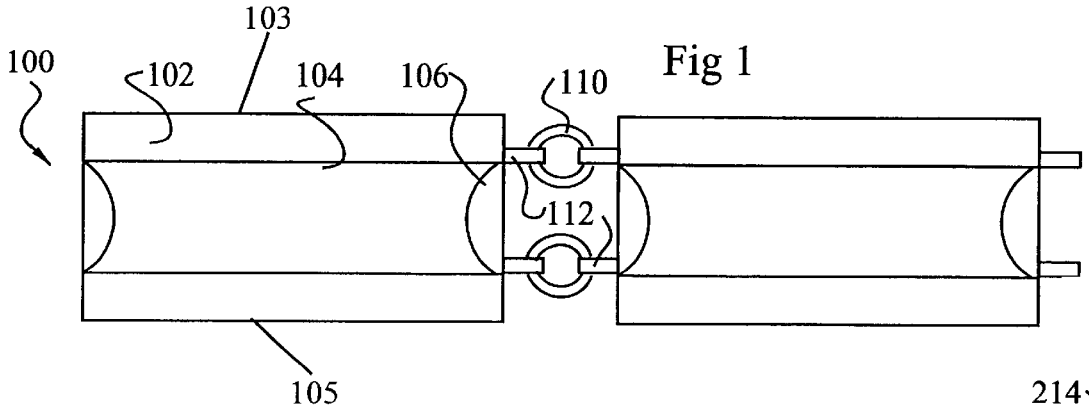
Fig 1
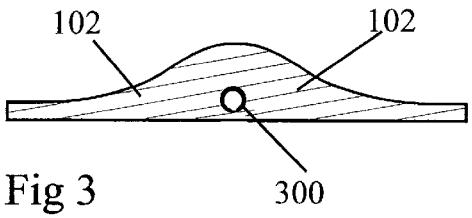
Fig 3
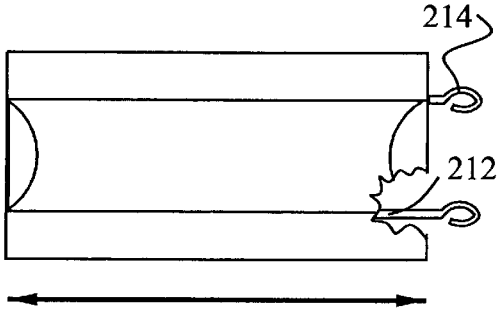
Fig 2
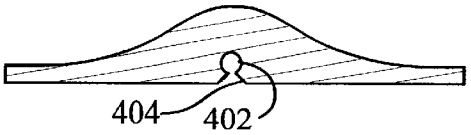
Fig 4
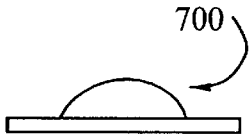
Fig 7
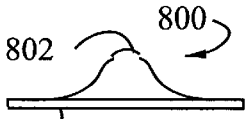
Fig 8
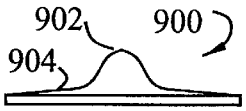
Fig 9
Fig 5 Prior Art
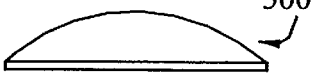
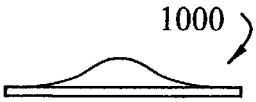
Fig 10
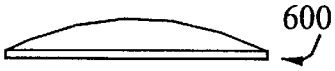
Fig 6 Prior Art
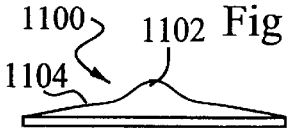
Fig 11

Fig 12
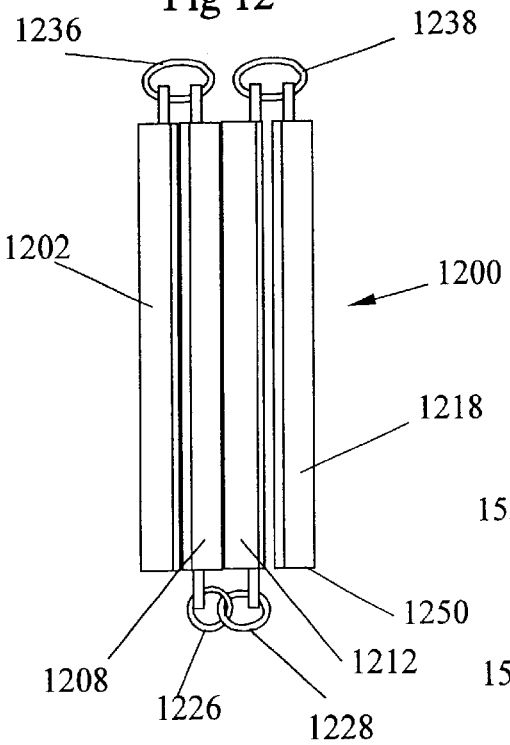
Fig 13
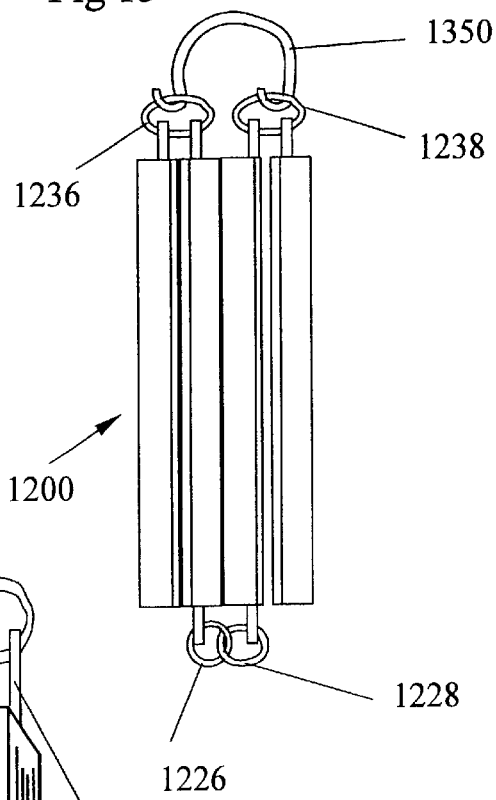
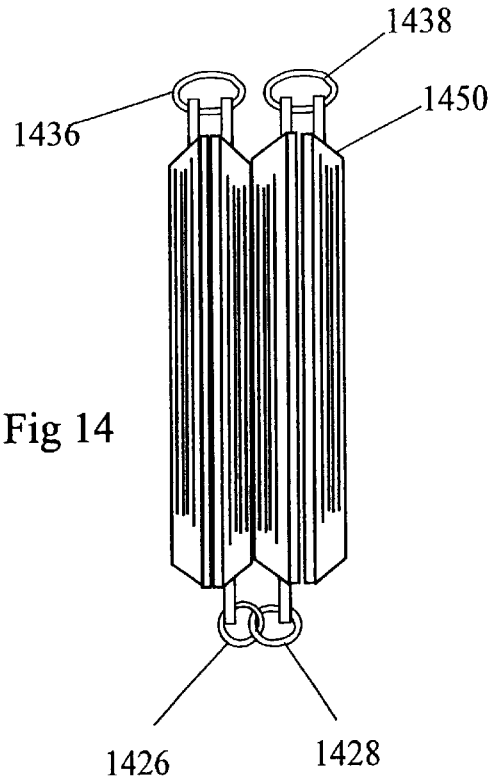
Fig 14
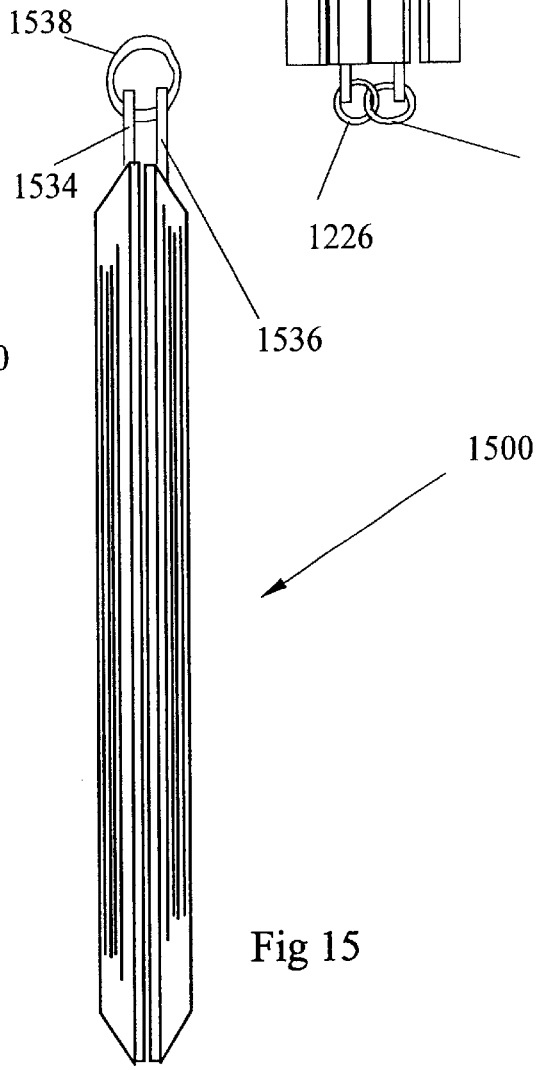
Fig 15

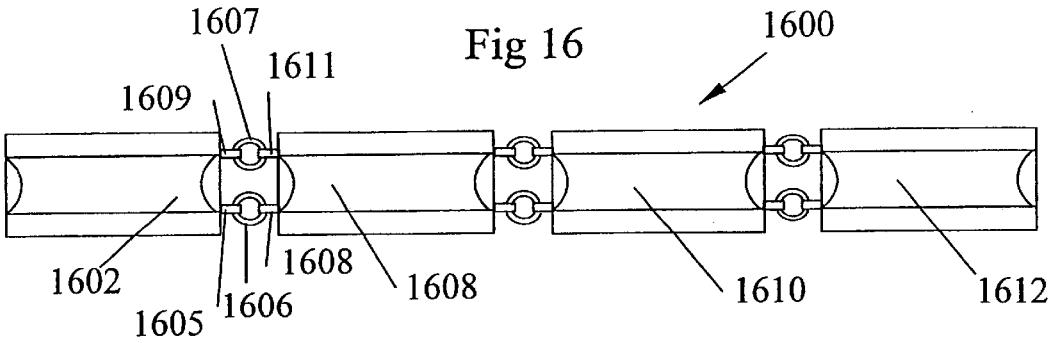
Fig 16
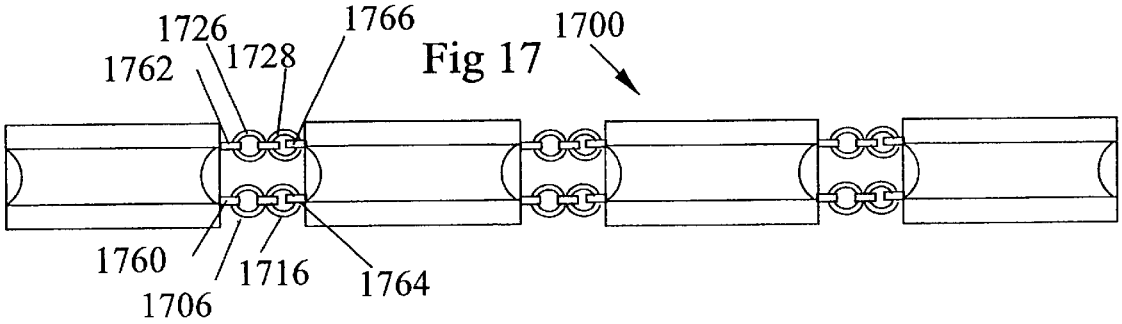
Fig 17
Fig 18
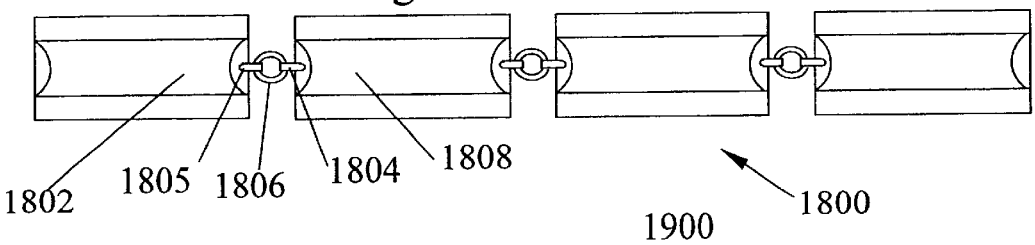
Fig 19
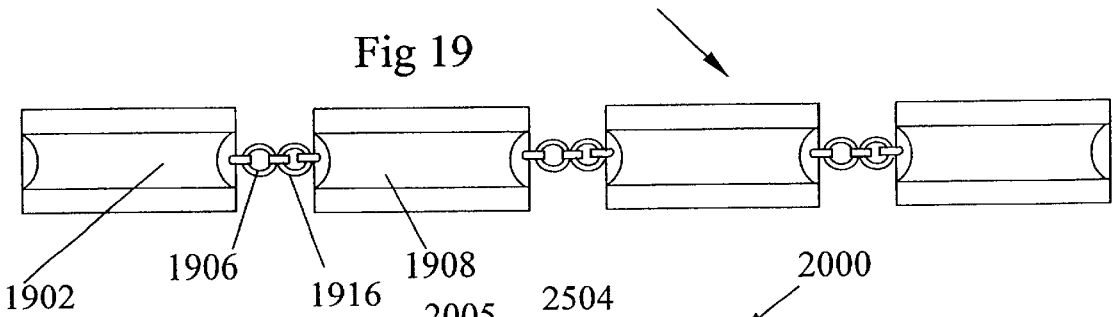
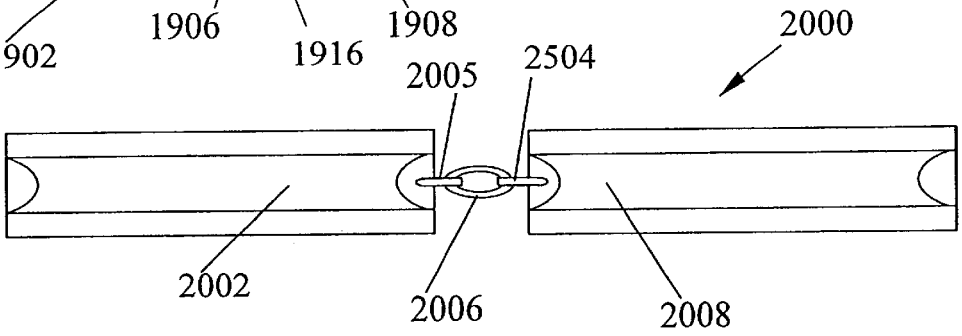
Fig 20

PORTABLE SPEED BUMP FOR TRAFFIC REGULATION

BACKGROUND OF THE INVENTION

1. Field of the Invention

The invention relates to traffic regulating speed bumps, and more particularly, to a novel design of a portable speed bump for temporary traffic regulation.

2. Brief Description of the Prior Art

The value of track bumps, also known as traffic humps, is well established. They provide a simple mechanism for necessitating drivers to reduce the speed of the vehicle. They do not produce a road hazard to the vehicle and thus have no significant negative side effect. There are times and circumstances under which it is necessary to install a road bump rapidly, or temporarily.

It has been proposed to produce traffic bumps that can be secured to a roadbed by an adhesive or fasteners such as nails or screws.

SUMMARY OF THE INVENTION

It has now been found that a portable traffic bump can be designed that is convenient to carry in a vehicle, position on a roadway, and that stays immobile in use, without being secured to the roadway. Thus, the traffic bump can be used on an as needed basis, and removed as desired. The traffic bump does not cause any damage to the roadbed.

BRIEF DESCRIPTION OF THE DRAWINGS

FIG. 1 is a top view of two modules of the present invention linked together.

FIG. 2 is a fragmentary top view, of a single speed bump module of FIG. 1.

FIG. 3 is an end view of the speed bump of FIG. 1.

FIG. 4 is an end view of a variation of the embodiment of FIG. 1.

FIG. 5 is an end view of the prior art speed bump.

FIG. 6 is an end view of a variation of the embodiment of the prior art.

FIG. 7 is an end view of the speed bump of the present invention.

FIG. 8 is an end view of an alternative embodiment of present invention.

FIG. 9 is an end view of a variation of the embodiment of FIG. 8.

FIG. 10 is an end view of an additional variation of the present invention.

FIG. 11 is an end view of a further variation of the present invention.

FIG. 12 is a top view of four sections of the present invention folded upon themselves.

FIG. 13 is a top view of the embodiment of FIG. 12 with a hook/handle placed through two of links.

FIG. 14 is a top view of an alternative embodiment of the present invention folded for storage.

FIG. 15 is a top view of a variation of the present invention where two modules are linked to form one section.

FIG. 16 is a plan view of four modules each having a pair of link rods.

FIG. 17 is a plan view of four modules each having an alternative embodiment of a pair of link rods.

FIG. 18 is a plan view of four modules each having a further alternative embodiment of a linking rod.

FIG. 19 is a plan view of four modules each having a still further alternative embodiment of a linking rod.

FIG. 20 is a plan view of two long modules each having a linking rod.

DESCRIPTION OF THE PREFERRED EMBODIMENTS OF THE INVENTION

Figure 21:
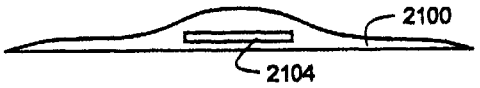
FIG. 21 is an end view of another embodiment of a speed bump.
Figure 21A:
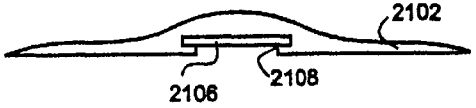
FIG. 21*a* is an end view of a variation of the embodiment of FIG. 21.

The traffic bump of the present invention can be in interlinked sections. Alternatively, a two, three, or four section traffic bump can be provided. The interlinking of the individual traffic bump sections provides the advantage of providing a modular design in which each individual section can be moved independently of the other section. Thus, the weight of the bump sections can be within the limits considered reasonable for handling by the personnel who are installing or removing the temporary speed bump. Additionally, the modular design provides the advantage of being in small component elements which can readily be stored in the trunk of a car, as well in the storage region of a trunk. In numerous applications, at least a pair of speed bumps is required in order to handle traffic in two directions. As for example in a situation in which a person is working in a utility opening in a road, there is a need to slow traffic in both directions. This is necessary because the utility access openings in roadways is typically in the center of the road and the traffic passes on two sides of the utility repair or maintenance personnel. The impact of the vehicle against the speed bump will tend to move the speed bump. This is typically countered by permanently fixing the speed bump to the roadway. Where the speed bump is to be used for a few hours or a few days, fastening the speed bump to the roadway would not be practical due to the cost of repairing the roadway upon removal of the speed bump.

The speed bump is advantageously produced as an extrusion. The extrusion production process has the advantage of providing extremely high-speed production rates, thus moderating costs. It is preferred to provide the speed bumps with at least one rigid connecting rod. The connecting rod preferably extends the full length of each modular section. On at least the center sections, the connecting rod extends beyond the modular section and provides a mechanism for interlinking the proximate modular sections. The end units can have the connecting rod extending from a single end.

While it is highly preferable that the interconnect rod be rigid, it is possible to use a moderately flexible rod.

The interlinking of proximate section provides the advantage that each section restricts the movement under impact, of a section that is contacted by the wheel of the vehicle that is passing over the modular section. Obviously, the more rigid the interlinking or connecting rod, the greater is the restriction of the movement of each section. Alternatively, where the interlinking member is a flat, elongated plate like device, door hinge like connectors can be employed to provide rigidity against movement parallel to the plane of the road bed, but providing for easy of folding and through the removable of a simple pin, ease of disconnecting of adjacent modules.

While the drawings illustrate the use of link element of the type that would be found in chains, the connecting of proximate section can be achieved through the use of turnbuckles. In this embodiment, the exposed ends of the connecting rods are threaded, with the treads matching the internal threads of the turnbuckles.

The configuration of the speed bumps can affect the stability of the system under impact. The steeper the sides of the speed bump, the greater is the severity of the impact of the vehicle wheels on the speed bump. That is, speed bumps that have steep sidewalls have a greater tendency to move under impact than softly sloped speed bumps. The speed bump preferably is highly visible and provides a strong warning signal to approaching traffic. The greater the severity of the slope of the sides of the speed bump, the greater the appearance of a substantial obstacle. Preferably, the sidewall of the speed bump is color coded to signal a road obstacle and to provide the appearance of a formidable obstacle.

The color-coding can be in the form of an elongated stripe that runs the length of the speed bump. Alternatively, the color-coded stripe can be a plurality of parallel diagonal stripes. The connecting rod can be inserted in the extruded length during the extrusion process. This provides a manufacturing problem, in that the length of the connecting rods must be longer than the length of the modular sections. Advantageously, the rod can be inserted into the modular section after the speed bump extrusion is cut into modular section.

The cross section of the speed bump preferably is such that there is a leading and trailing ramp. The wheel of the vehicle rides upon the ramp section that has little or no inclination. Therefore, is there is minimal impact between the speed bump and the wheel of the vehicle. After the wheel is on the ramp, thus locking down the speed bump, the rides up the inclined section of the speed bump. When the wheel impacts the sloped side of the speed bump, the speed bump cannot move away from the wheel, because the speed bump is carrying the weight of the car. The shape of the speed bump contributes to the ability to insert the connecting rod into the elongated recess provided in the speed bump for the connecting rod. The speed bump is bent or twisted about the centerline of the speed bump, thus opening the entrance to the connecting rod receiving recess. The rod is then pressed into the open recess and locked in place by releasing the speed bump, and permitting the speed bump to return to its original shape.

The length of each speed bump module is not narrowly critically, particularly where the speed bump modules are relatively rigidly locked together. The typical width of a roadway is about eight feet, and thus, the number of modules employed in combination, times the length of the modules should be approximately equal to the road width. For a typical roadway having two lanes of traffic that is to be regulated, eight two-foot sections can be used. The use of four, four-foot sections would yield modules having a greater per unit weight than the two foot sections. While this would contribute to resistance to movement, it renders each module more difficult to carry by hand, and more difficult to store. However, in the case of turnbuckle secured modules, the modules can readily be completely separated. Where the modules are linked, the use of a greater number of modules renders the combination more prone to shifting, but more adaptable to storage in confined areas.

The speed bump height is preferably about one to about one and one half inches in height, by at least twelve inches wide. The speed bump must have sufficient mass to render the speed bump stable under the impact between the wheel and the speed bump. The speed bump height is preferably no greater than three inches. The width of the speed bump can be up to three feet. The greater the height, width the greater the cross sectional area of the speed bump. The greater the rate of increase in height of the bump the greater the cross sectional area of the bump, and the greater the weight and stability. A square cross sectional area would provide the maximum mass. Obviously, the use of vertical sidewalls is highly undesirable. A half circle or elliptical cross section is also undesirable since it would provide too severe an impact and consequently, would produce a speed bump which would move and consequently be unstable.

The use of a leading and trailing ramp can serve to counter the tendency of the ramp to move under the impact of the wheel. Thus, a half circle, or a lesser portion of a circle or of an ellipse can be used, if combined with an entrance ramp configuration. Optimally, the entrance ramp is used in combination with an exit ramp.

The stability of the ramp, that is, the ability of the ramp to resist movement can be further enhanced through the use of a non-skid pattern on the bottom surface of the speed bump. The non-skid pattern can be in the form of blade shaped elements that project from the speed bump bottom surface. Advantageously, the elongated planar elements are in two parallel sets, with each set being at an angle to the base of the speed bump. The angle is preferably away from the direction of travel of the vehicle.

The speed bump can be used for travel in either direction and therefore, advantageously, the inclined ribs can be inclined toward, or away from the centerline of the speed bump. This produces a reversible speed bump.

Other non-skid patterns can be used to increase the frictional resistance to movement between the speed bump and the roadway.

Unlike a semi-circular cross-sectional speed bump, a speed bump having an entrance ramp will be subject to a greater torquing opposite the vehicle's direction of travel, than to a pushing or impact force in the direction of travel of the vehicle. This is particularly true with designs in which the incline has a gentle slope. The gentle slope will result in the car climbing the incline rather than pushing the speed bump.

It should be understood that the term roadway is not intended to be restricted to any particular type of road. It is intended to indicate any type of surface that is paved for the travel of vehicles. Thus, it is inclusive of indoor garages, parking lots, highways, and driveways.

The material of the speed bump is advantageously, a natural or synthetic rubber such as an acrylonitrile-butadiene-styrene polymer. Other material can include synthetic polymers such as high-density polyethylene and composite materials, such as glass fiber reinforced plastics. Where the speed bump is made of a rigid material such as a metal, the road contacting surface can be coated with a non-skid material or it can be bonded to a layer of a non-skid material.

FIG. 1 shows a pair of speed bump modules indicated generally as 100. The modules can include a gently sloped entrance and exit section 102 and a more steeply inclined elongated interior section 104. The transition from section 104 to sections 102 can be very gradual, and it is not intended to indicated that the three sections are discrete elements. Rather, typically, there is a gradual transition between the approach edge 103 and the exit edge 105. As illustrated, the modules have sloped, or crowned outer ends 106 to accommodate a tire riding the ends of the speed bumps indicated as 100. The two modules are held together by the links 110, which are secured to the ends of the rods 112.

FIG. 2 shows an embodiment in which a pair of rods 212 and 214 are embedded in the modules for added weight, reinforcement and for providing a connecting link. The number of reinforcing rods can be modified to accommodate the requirements of the system, and as illustrated in FIG. 3, a single, formed in place, rod 300 can be employed. If the rod is to be added after the forming of the module, the rod accepting opening 402 can be provided with an entrance openings 404.

Prior art speed bumps, indicated generally as 500, and 600, are typically units with a simple arcuate cross-section. Advantageously, the speed bump modules are provided with leading and trailing sections, such that the tire is on the speed bump prior to encountering the more steeply sloped center section. Various speed bump cross-sections can be employed, as indicated generally as 700, 800, 900, 1000 and 1100, in FIGS. 7 through 11, respectively. The central region 802 can have steeply sloped sides providing a steep transition from the leading and trailing section 804. A steep transition from the leading edges 904 to the high central section 902 is illustrated in Figure 900. The embodiment of FIG. 9 shows a lower total height than the modification of FIG. 8, but a steeper transition. FIG. 11 illustrates the preferred embodiment, in which the transition from the leading edge 1104 to the high point of the central section 1102 of the module 1100, is very gradual.

The modules are preferably designed to link together in a manner which permits the modules to be folded upon each other for compact, combined storage. The four modules 1202, 1208, 1218 and 1212, are indicated generally as 1200, can be linked together by chain type links 1236, 1238, 1226 and 1228. In this modification, the ends of the modules 1250 are flat, as would result from the cutting of an extrusion into individual modules.

As illustrated in FIG. 13, the folded modules 1200 can be carried by a single element 1350 that has hooked ends for engaging the links 1236 and 1238.

FIG. 14 shows modules which have sloped end sections 1450, to more readily accommodate the tires of cars. The modules are held together by the links 1426, 1428, 1436 and 1438. As shown in FIG. 15, the speed bump 1500 can be formed of a pair of modules. The two modules have their proximate ends secured together by link 1538, that is fixed to the ends of rods 1534 and 1536.

FIGS. 16 through 20 show modules 1600, 1700, 1800, 1900 and 2000, respectively. The modules can have either single reinforcing rods 1805 and 1804 or a pair of rods 1609 and 1605, and 1604 and 1611, of FIG. 16 and 1760 and 1762, and 1764 and 1766 of FIG. 17. Similarly, the modules can employ a single connecting link 1607 and 1606 between the modules, 1600 of FIG. 16, 1806 of FIGS. 18 and 2006 of FIG. 20, or alternatively, pairs of connecting links 1726–1728, 1706–1716, and 1906–1916 of FIGS. 17 and 19 respectively. It is noted that the modules 2002 and 2008 of FIG. 20 are long enough that two modules form the unit 2000. The Single link 2006 is secured to the rods 2005 and 2504.

Figure 33:
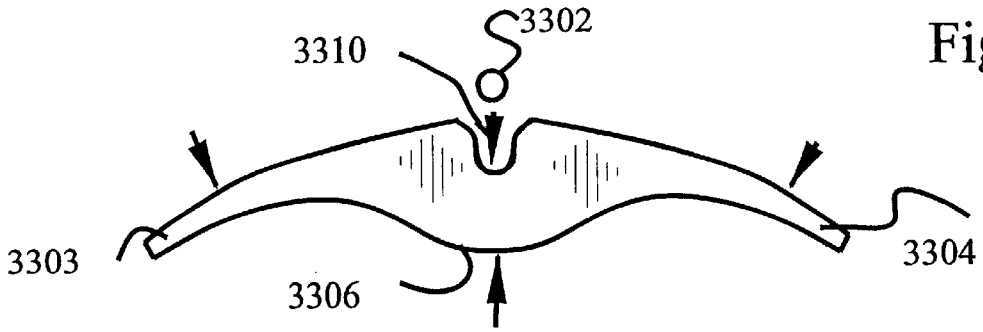
FIG. 33 is an end view of a speed bump of the present invention in twisted configuration to accept a reinforcing rod.

Advantageously, the modules can have a metal plate 2104 embedded in the speed bump body 2100. The speed bump 2100 can be formed by compression molded with the internal metal plate molded in place. Alternatively, the speed bump 2102 can be formed by extrusion, in which case the metal plate 2106 is pressed into the recess 2108 in the speed bump. As illustrated in FIG. 33, the speed bump can be bent at the high point with the outer sections being forced toward the hump of the speed bump. Similarly, the speed bump 2102 can be torqued and the recess 2108 opened to receive the metal plate 2106.

Figure 22:
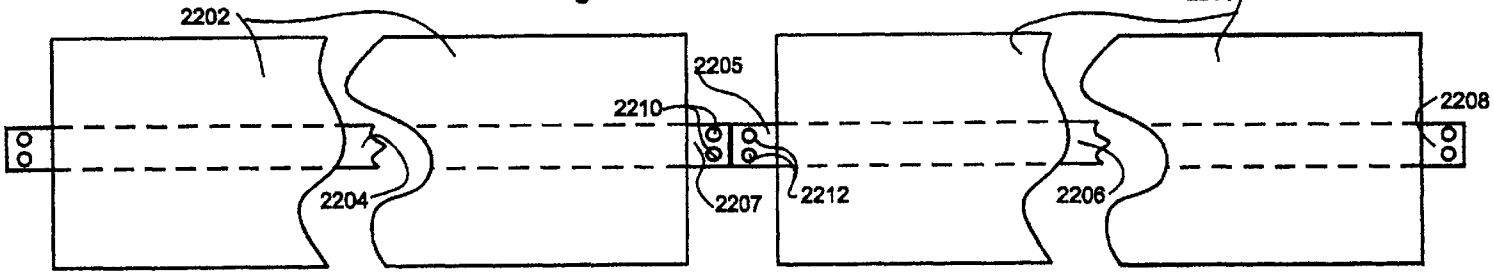
FIG. 22 is a fragmentary top view, of a pair of speed bumps of FIG. 21.
Figure 23:
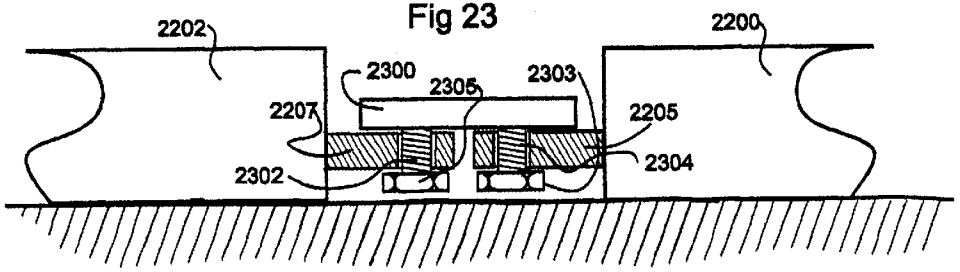
FIG. 23 is a fragmentary side view, partly in cross-section of a pair of speed bumps that are bolted together.

As shown in FIG. 22, the speed bumps 2202 and 2200 can be positioned end to end, such that the end sections 2205 and 2207 of the metal plates 2206 and 2204 respectively, are proximate each other. A connector or bridge plate 2300 is positioned over the metal plate ends 2207 and 2205. The metal connector 2300 can be provided with pairs of bolts 2302 and 2304 positioned for insertion into the bolt holes 2210 and 2212 of the metal plates 2202 and 2200. When the connector plate and bolts are in position, the nuts 2305 and 2303 can be threaded on their respective bolts and the two speed bumps 2202 and 2200 are firmly locked together.

It should be noted that the bridge, or over lapping plate 2300 can be shaped to essentially completely fill the open space between the ends of the modules 2202 and 2200. In this manner, the modules form an essentially continuous length from end to end. This modification is advantageously employed in combination with four module speed bumps. There is minimal likelihood that the tires of a car can pass over the connectors where only two modules are used, since the car would have to at an extreme position in the road, to have a set of tires positioned in the middle of a lane.

Figure 24:
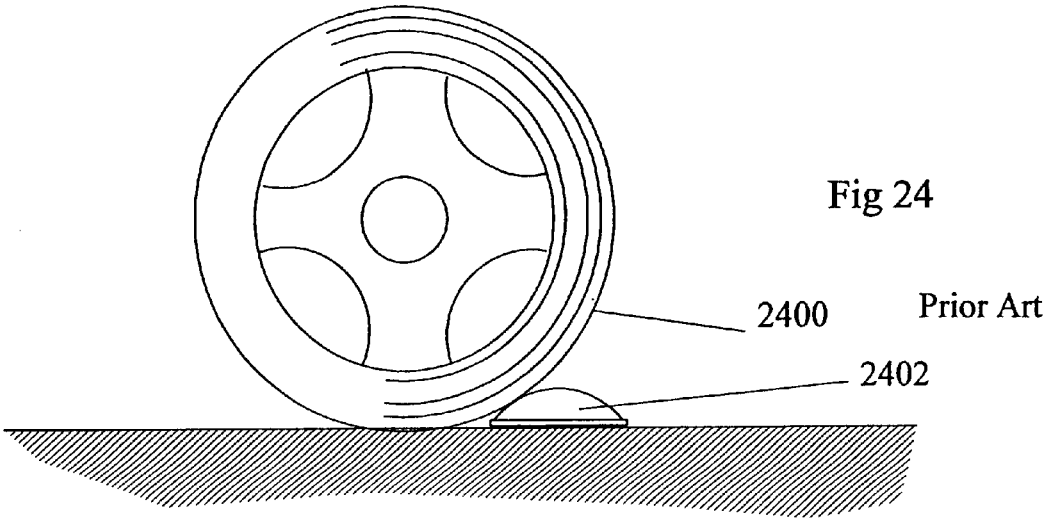
Fig 24 Prior Art
FIG. 24 is a side view of a tire in contact with a prior art speed bump.
Figure 25:
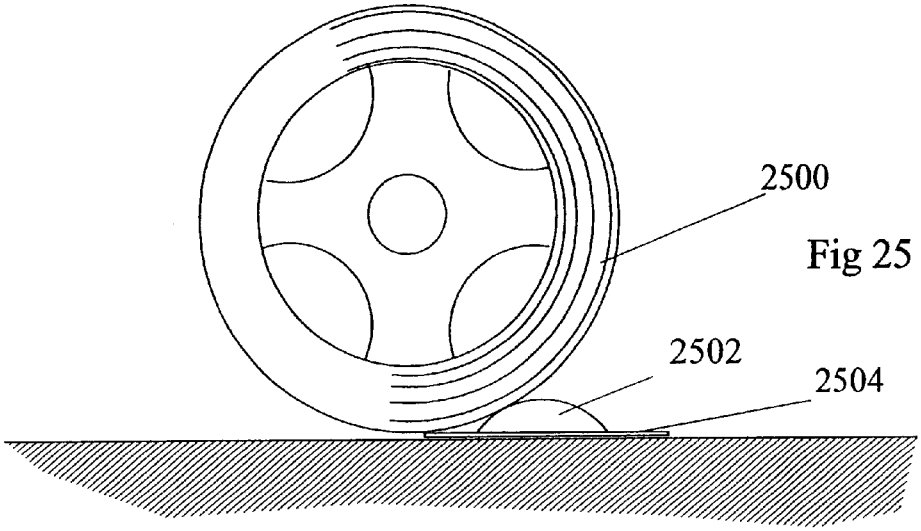
FIG. 25 is a side view of a tire in contact with a speed bump of the present invention.
Figure 26:
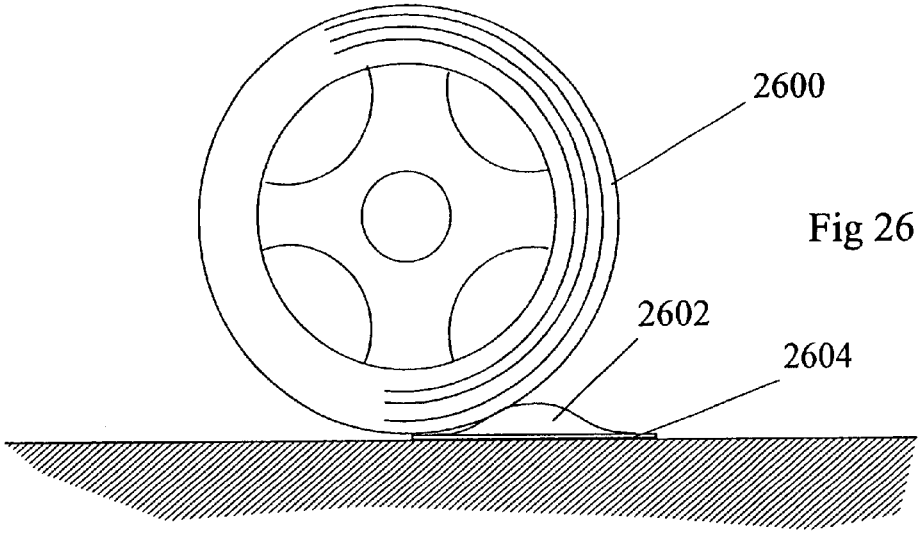
FIG. 26 is a side view of a tire in contact with an alternate embodiment of a speed bump of the present invention.
Figure 27:
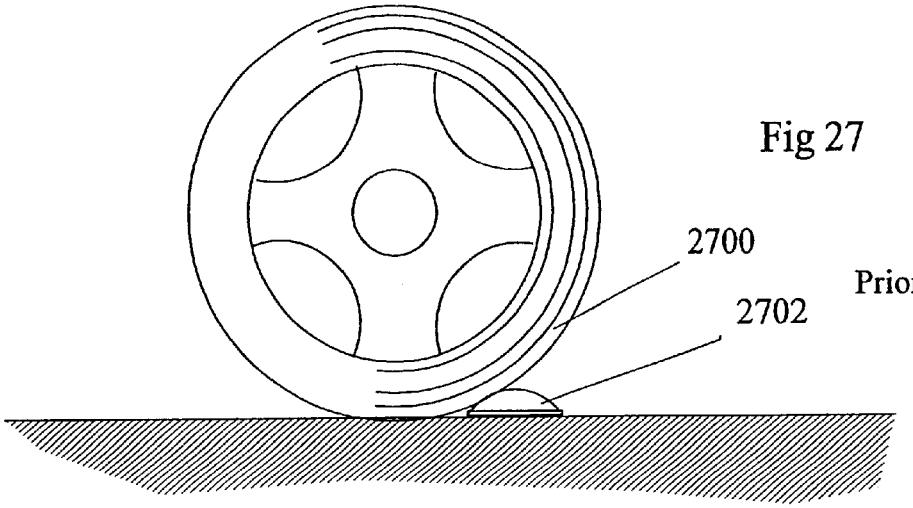
Fig 27 Prior Art
FIG. 27 is a side view of a tire in contact with a prior art speed bump.
Figure 28:
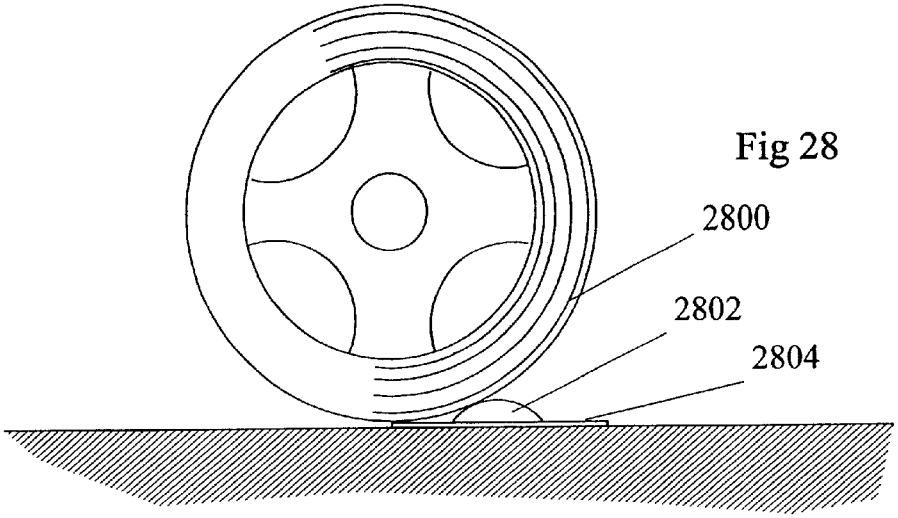
FIG. 28 is a side view of a tire in contact with a further speed bump of the present invention.
Figure 29:
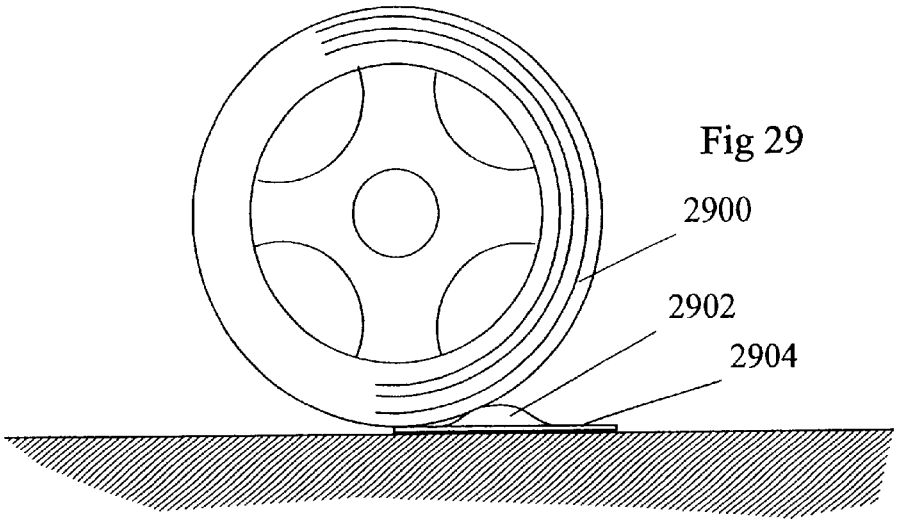
FIG. 29 is a side view of a tire in contact with a further alternate embodiment of a speed bump of the present invention.
Figure 30:
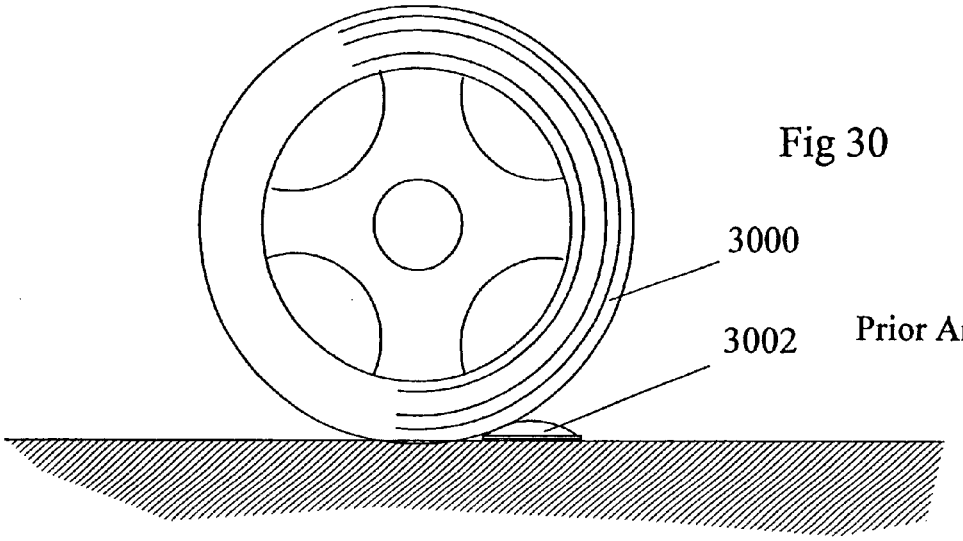
Fig 30 Prior Art
FIG. 30 is a side view of a tire in contact with a prior art speed bump.
Figure 31:
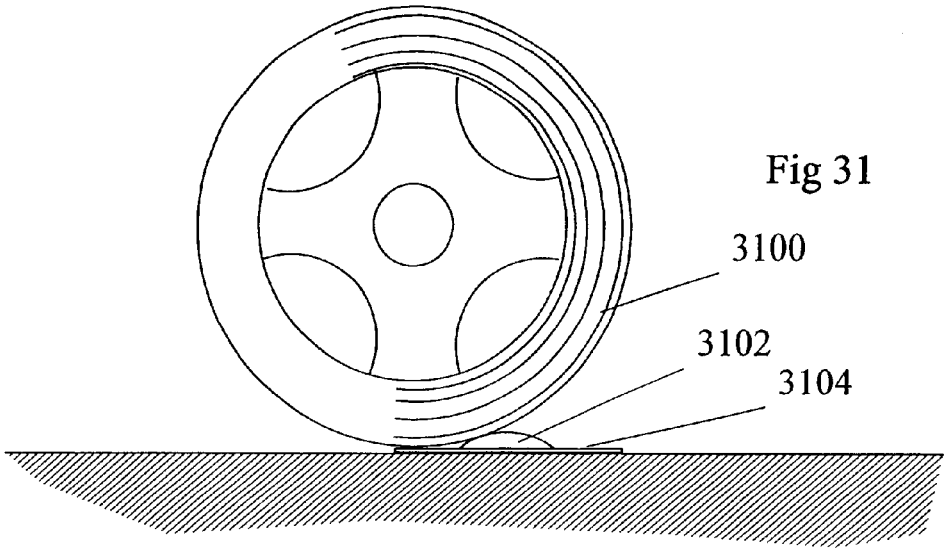
FIG. 31 is a side view of a tire in contact with an alternate speed bump of the present invention.
Figure 32:
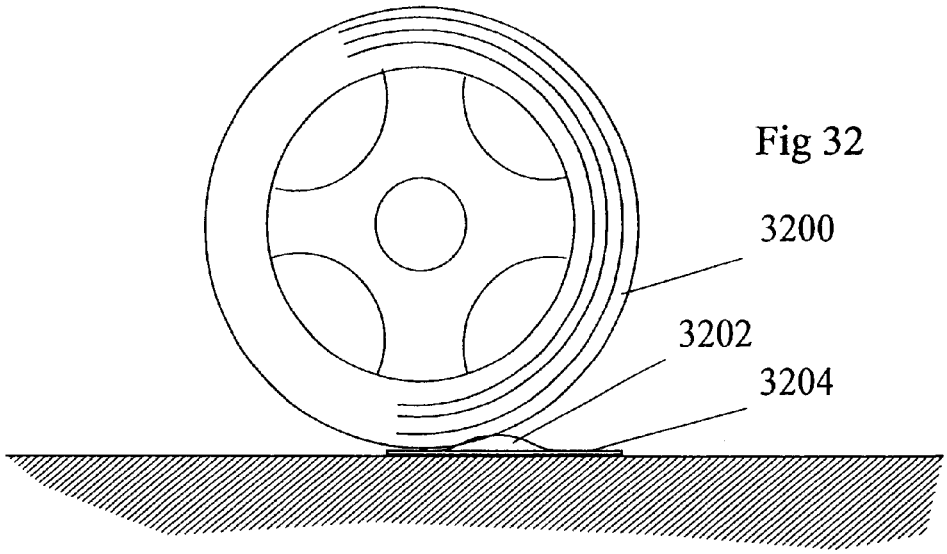
FIG. 32 is a side view of a tire in contact with a still further alternate embodiment of a speed bump of the present invention.

FIGS. 24 through 32 show speed bumps of varying cross-sections. FIGS. 24, 27 and 30 show various height prior art speed bumps. FIGS. 25, 28 and 31 show arcuate speed bumps of progressively decreasing size and FIGS. 26, 29 and 32, show more gradual progression speed bumps of progressively decreasing dimensions. The tires 2400, 2700 and 1000 would impact significantly with each of the respective speed bumps 2402, 2702 and 3002. The same would be true for the tires 2500, 2800 and 300. However, the tires 2500, 2800 and 1100 would be positioned on the leading edges 2504, 2804 and 3104 respectively, thus tending to hold the speed bump in place. Advantageously the tires 2600, 2900 and 3200 would engage the risers 2602, 2902 and 3202 more gradually due to the gentler slope than is shown in the prior embodiments of FIGS. 24, 25, 27, 28, 30 and 31. Moreover, the tires 2600, 2900 and 3200 would be positioned on the leading edges 2604, 2904 and 3204 respectively, thus further tending to hold the speed bump in place.

The insertion of the reinforcing rod 3302 and indicated by the arrow 3310 can be accomplished by pressing in a first direction on the modules ends 3303 and 3304, while pressing in the opposite direction and the high point 3306. In this manner the rod receiving opening is accessible to the rod, and the rod can readily be forced in place. In normal use, the rods 3302 are locked in position.

The leading edge of the modules indicated by the arrows 3410 should be moderately tapered, and advantageously, is about ⅛ to ¼ inch.

The height of the speed bump at its maximum, as indicated by the arrow 3406, should be in the range from about 1½" to about 2".

The width of the speed bump, as indicated by arrow 3420, should be in the range from about 12" to about 18". The width is directly related to skid resistance so increasing the width increases the skid resistance.

Figure 34:
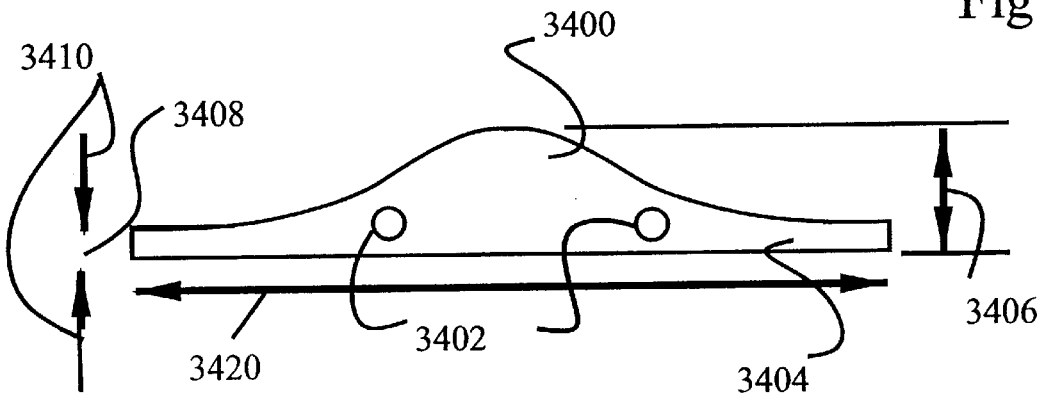
FIG. 34 is an end view of another embodiment of a speed bump of the present invention.
Figure 35:
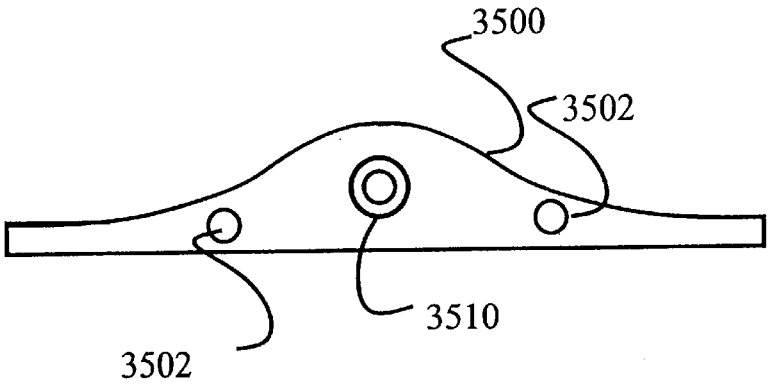
FIG. 35 is an end view of still another embodiment of a speed bump of the present invention.

The number of rods employed can be varied to accommodate the desired weight and rigidity of the modules. Thus, FIG. 34 and 35 illustrate the use of two rods 3402 and three rods 3503, and 3510 respectively.

Figure 37:
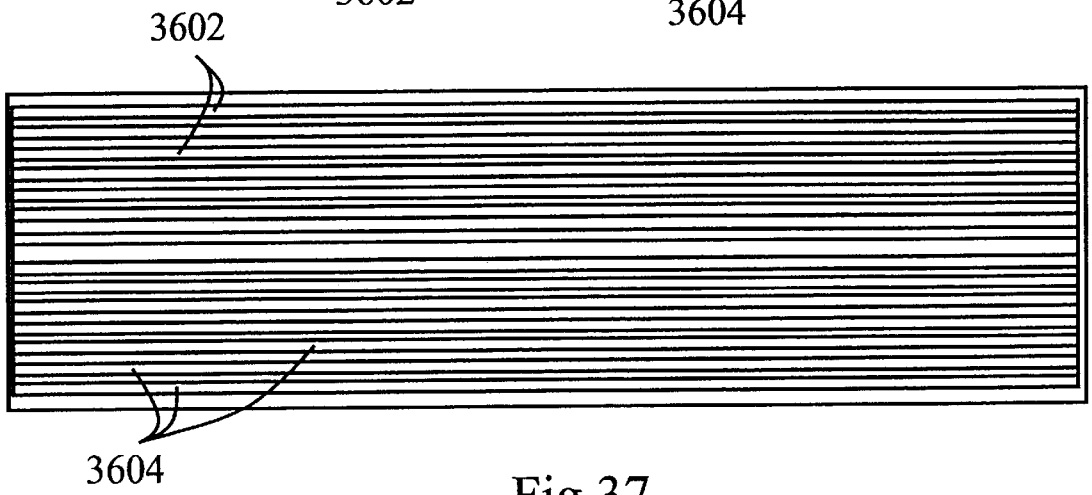
FIG. 37 is a bottom view of the modification of FIG. 36.
Figure 38:
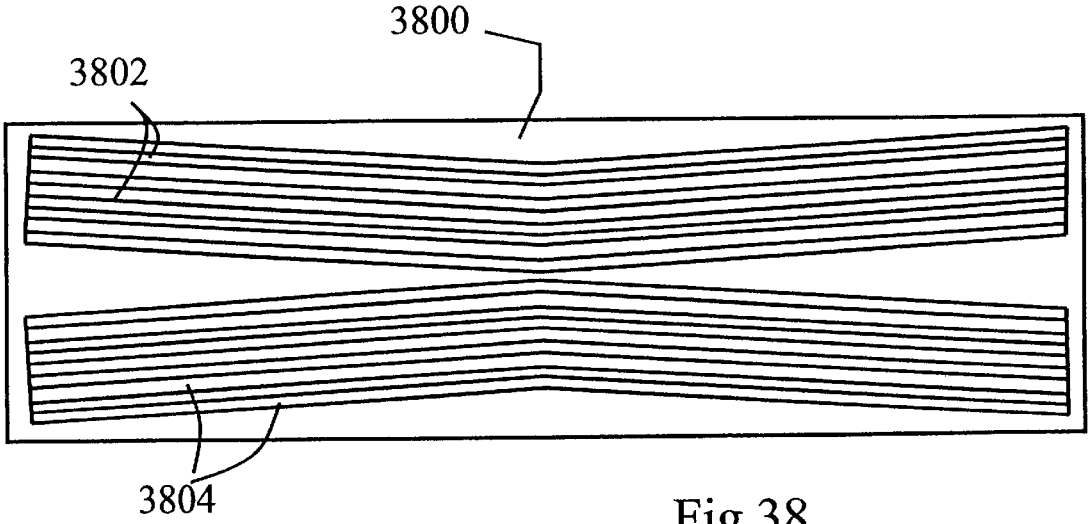
FIG. 38 is a bottom view of an alternate embodiment of anti-skid projections.

The speed bump modules 3400 is advantageously provided with elongated fins, or fingers, 3602 and 3604, projecting downwardly and outwardly from the bottom surface 3402 of the module 3400. Advantageously, the fingers can be over essentially the entire bottom surface from the outer edges of the trailing and leading sloped section 3404 to the centerline of the module, as illustrated in FIG. 37.

Figure 36:
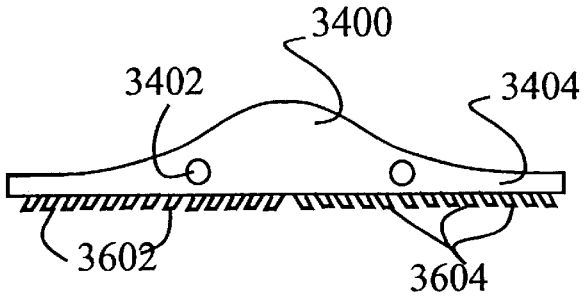
FIG. 36 is an end view of a modification of the speed bump of FIG. 34, showing anti-skid projections.

Alternatively, to the straight lines of the fingers 3604, the fingers 3802 and 3804 can be in a chevron pattern. The pattern of FIGS. 36 and 37 can be formed in an extrusion process, while the pattern of module 3800, is most readily formed in a mold. The chevron pattern provides resistance to movement of the speed bump modules 3800 both inline with the direction of travel of the vehicle that passes over the speed bump, and transverse to the direction of travel.

What is claimed is:

1. A portable speed bump, for use in limiting the speed of vehicles that are traveling on a road, comprising in combination:

a plurality of elongated speed bump modules, each module having a cross-section with a lower planar surface, a low slope leading edge region and a trailing edge region from the outer edges toward a convex mid-line region and a substantially increased concave slope region proximate the module mid-line, said increased concave slop region having relative dimensions such that vehicles ride on said leading edge region before riding on said convex mid-line region, wherein said modules have a height of no greater than three inches, a width of at least sixteen inches, and a length of at least three feet.

2. The portable speed bump of claim 1, wherein each module has a length of at least two feet, a width of at least one foot, and a height of at least one inch.

3. The portable speed bump of claim 2, wherein each module has a curved upper surface and a planar lower surface, and an elongated connecting member receiving recess in said planar lower surface.

4. The portable speed bump of claim 3, further comprising anti-skid elements extending from said planar lower surface, whereby lateral movement of said speed bump is resisted.

5. The portable speed bump of claim 3, further comprising a plurality of substantially parallel, outwardly angled anti-skid fingers extending from said planar lower surface, whereby lateral movement of said speed bump is resisted.

6. The portable speed bump of claim 2, wherein each module has an upper surface which has a gradual slope from outer edges to the peak at the speed bump mid-line.

7. The portable speed bump of claim 6, wherein each module has an upper surface which has a concave slope region from outer edge to middle section.

8. The portable speed bump of claim 2, wherein each module has an upper surface that has a length of no greater than four feet.

9. The portable speed bump of claim 2, wherein each module having a width of up to about thirty inches.

10. The portable speed bump of claim 2, wherein each module has a curved upper surface and a planar lower surface, and at least one embedded, substantially rigid connecting member, extending from at least one end of each module.

11. The portable speed bump of claim 10, a first end of a first module having a first connecting member interconnecting region extending therefrom, a first end of a second module having a second connecting member interconnecting region extending therefrom, said first interconnecting region being releasably coupled to said second interconnecting region.

12. The portable speed bump of claim 11, said first interconnecting region being releasably coupled to said second interconnecting region by a hinge member.

13. The method temporarily limiting the speed of vehicles that are traveling on a road, comprising the steps of:

releasably coupling together a plurality of elongated speed bump modules having a length of at least three feet, a width of at least sixteen inches, and a height of at least one inch each module having a cross-section that has a planar lower surface and a upper surface having a low slope leading edge region and trailing edge region from the outer edges toward the mid-line and a substantially increased slope proximate the module mid-line, said modules having an upper surface which has a concave slope region from outer edge to middle section and a convex middle section, positioning each of said modules on a road bed with their long side at a substantially right angle to the direction of travel on said road bed, with said planar surface in non-attached contact with said road bed, such that vehicles ride on said leading edge region before riding on said convex middle region and ride on said trailing edge after riding on said convex middle region and removing said modules from said road bed, and uncoupling at least two of said modules.

* * * * *